US006971570B2

(12) United States Patent
Chang

(10) Patent No.: US 6,971,570 B2
(45) Date of Patent: Dec. 6, 2005

(54) STRIKER ASSEMBLY FOR A NAILER

(75) Inventor: Shin-Nan Chang, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 11/002,395

(22) Filed: Dec. 2, 2004

(65) Prior Publication Data

US 2005/0121491 A1 Jun. 9, 2005

(30) Foreign Application Priority Data

Dec. 3, 2003 (TW) ..... 92221265 U

(51) Int. Cl.[7] ..... B25C 1/04
(52) U.S. Cl. ..... 227/130
(58) Field of Search ..... 227/10, 129, 130, 227/147, 156; 173/132; 92/85 R, 130 R

(56) References Cited

U.S. PATENT DOCUMENTS 2,682,052 A * 6/1954 Juilfs ..... 92/130 R
3,056,137 A * 10/1962 Wandel et al. ..... 227/127
3,087,160 A * 4/1963 Doppelt ..... 227/130
3,099,012 A * 7/1963 Wandel ..... 227/123
3,434,643 A * 3/1969 Wandel ..... 227/130
3,703,125 A * 11/1972 Pauliukonis ..... 92/85 R
3,795,357 A * 3/1974 Lange ..... 227/130
4,530,455 A * 7/1985 Vornberger ..... 227/130
5,860,580 A * 1/1999 Velan et al. ..... 227/10
6,155,472 A * 12/2000 Deziel ..... 227/8
6,158,643 A * 12/2000 Phillips ..... 227/130
6,679,413 B2 * 1/2004 Miller et al. ..... 227/120

* cited by examiner

*Primary Examiner*—Scott A. Smith
(74) *Attorney, Agent, or Firm*—Charles E. Baxley

(57) ABSTRACT

A striker assembly for a nailer comprises: a striker formed with an inserting hole; a piston formed at its clamping portion with a receiving groove for insertion of the connecting end of the striker, on the clamping portion is an inserting hole; a pin inserted in the inserting holes of the striker and the piston; a gap is formed at either side of the striker, and protruding portions are formed on the piston according to the shape of the gaps of the striker, whereby the protruding portions are stably engaged with the gaps of the striker. Thereby, the connecting strength between the striker and the piston is improved, and the service life of the striker assembly is prolonged.

1 Claim, 7 Drawing Sheets

STRIKER ASSEMBLY FOR A NAILER

BACKGROUND OF THE INVENTION

1. Field of the Invention

The present invention relates to a nailer, and more particularly to a striker assembly for a nailer.

2. Description of the Prior Arts

Conventional striker assemblies for a nailer are generally divided into two categories: the first one is shown in FIG. 1, wherein the striker 20 is screwed with the piston 30; the second one is shown in FIG. 2, wherein the striker 20 and the piston 30 are defined with a inserting hole 22, 33 through which a pin 40 is inserted so as to connect the striker 20 and the piston 30 together.

Although these two conventional striker assemblies are simply structured, there are still some problems in manufacturing and in operation that could be improved:

First, for screw connection, the striker 20 and the piston 30 should be formed with threads 24, 35 by machining, and after being screwed together, adhesive agent will be used to solidify the screw connection between the striker 20 and the piston 30. Therefore, the production cost is accordingly increased.

Second, for pin connection, as shown in FIGS. 2 and 3, the connection between the striker 20 and the piston 30 will get loose after a certain period of use. The striking force will be transferred to the pin 40 in the inserting hole 22 of the striker 20, resulting in a deformation of the inserting hole 22, so that the pin 40 is likely to disengage from the deformed inserting hole 22, and the striker 20 will be damaged if it is in use.

The present invention has arisen to mitigate and/or obviate the afore-described disadvantages.

SUMMARY OF THE INVENTION

The primary objective of the present invention is to provide a striker assembly for a nailer, which comprises: a striker having a connecting end, at the connecting end formed an inserting hole; a piston having a protrusive clamping portion, at a top end of the clamping portion formed a receiving groove for insertion of the connecting end of the striker, at a periphery of the clamping portion formed an inserting hole; a pin inserted in the inserting hole of the striker and the inserting hole of the piston; wherein a gap is formed at either side of the connecting end of the striker, and protruding portions are made in the clamping portion of the piston by press machine and conform to the shape of the gap of the striker, whereby the protruding portions are integrally engaged with the gaps of the striker. By this method, the connecting strength between the striker and the piston is improved, thus prolonging the service life of the striker assembly.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
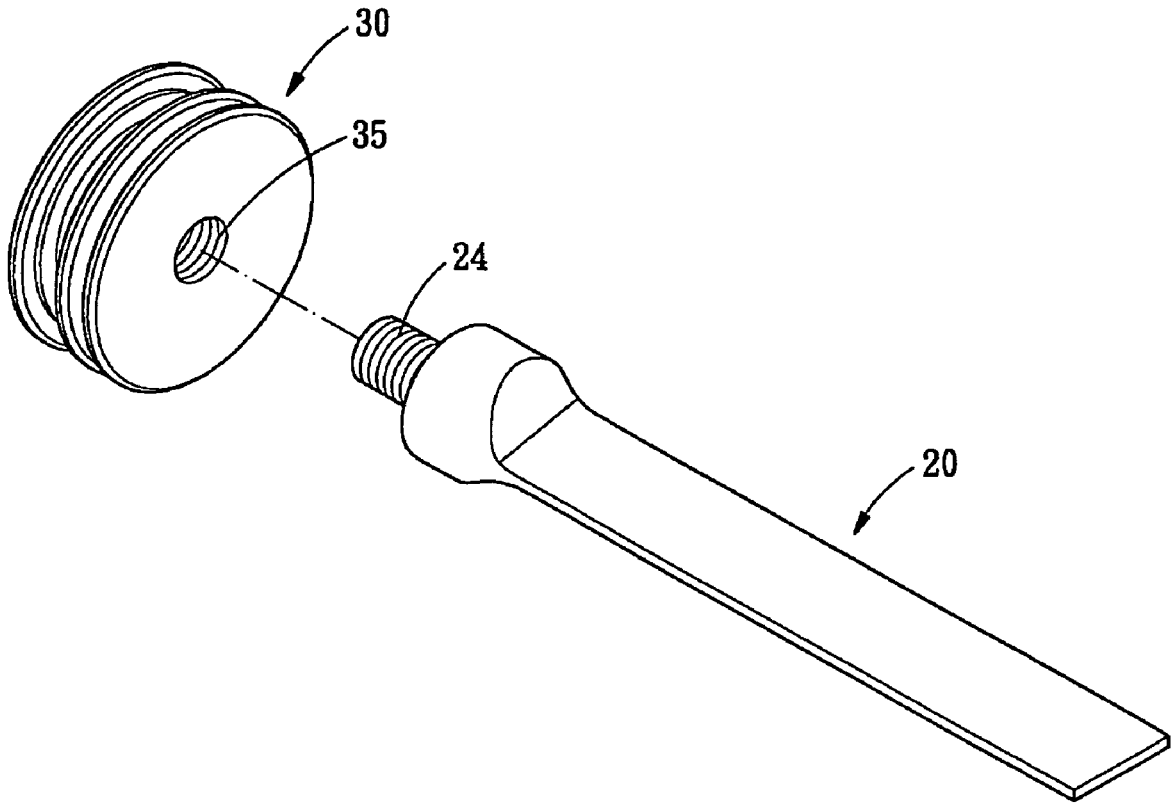
FIG. 1 PRIOR ART
FIG. 1 is an exploded view of a conventional striker assembly for a nailer.
Figure 2:
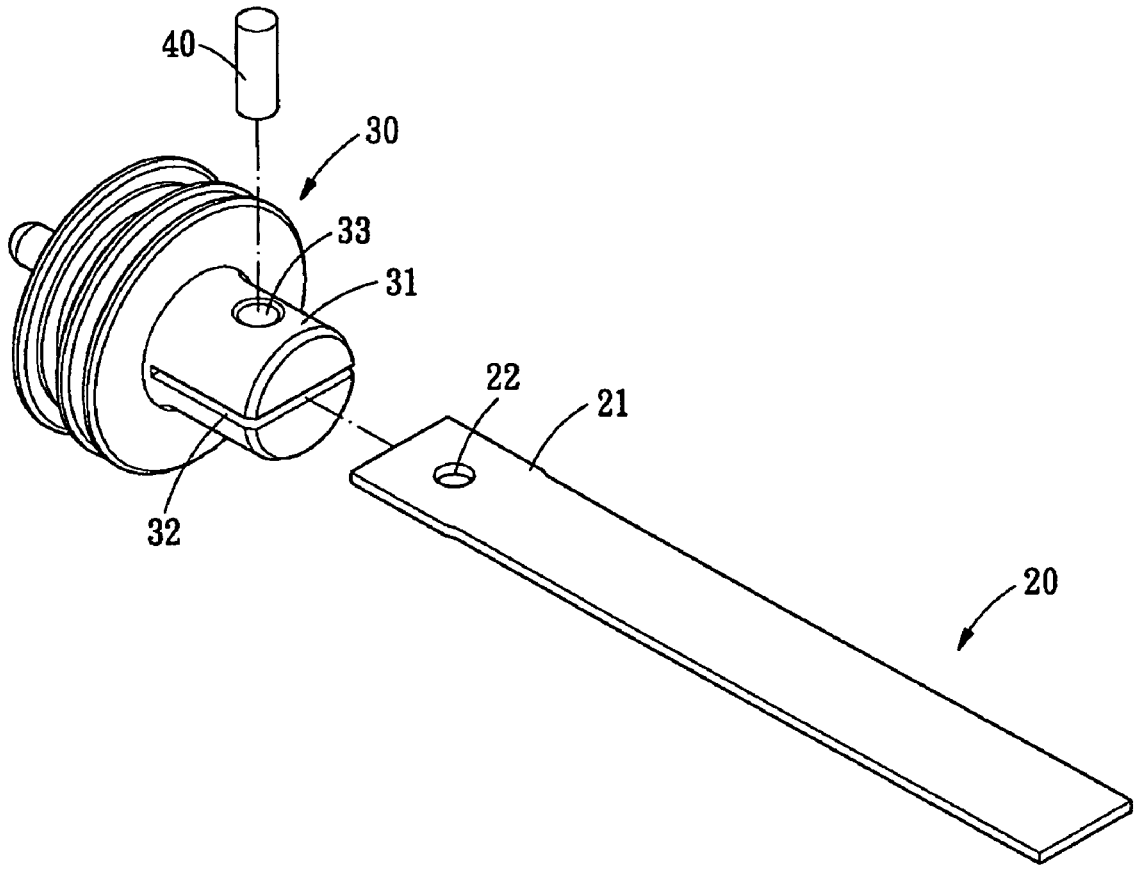
FIG. 2 PRIOR ART
FIG. 2 is an exploded view of another conventional striker assembly for a nailer.
Figure 3:
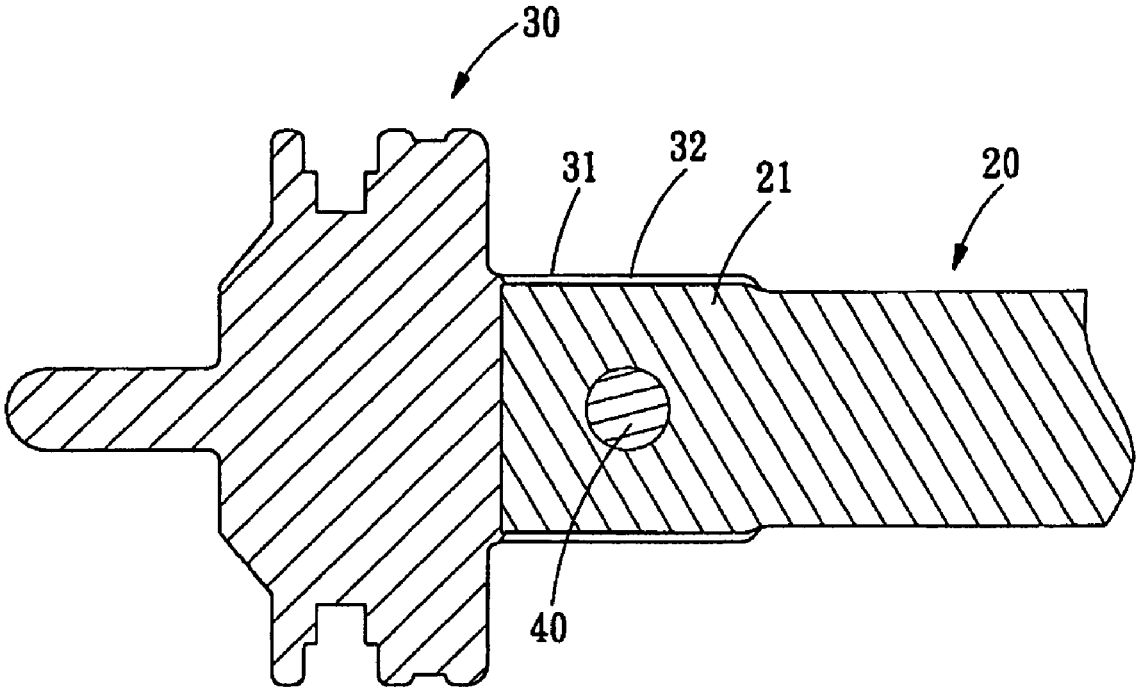
FIG. 3 PRIOR ART
FIG. 3 is a cross sectional view of the conventional striker assembly for a nailer, wherein the striker and the piston are connected together by a pin.
Figure 4:
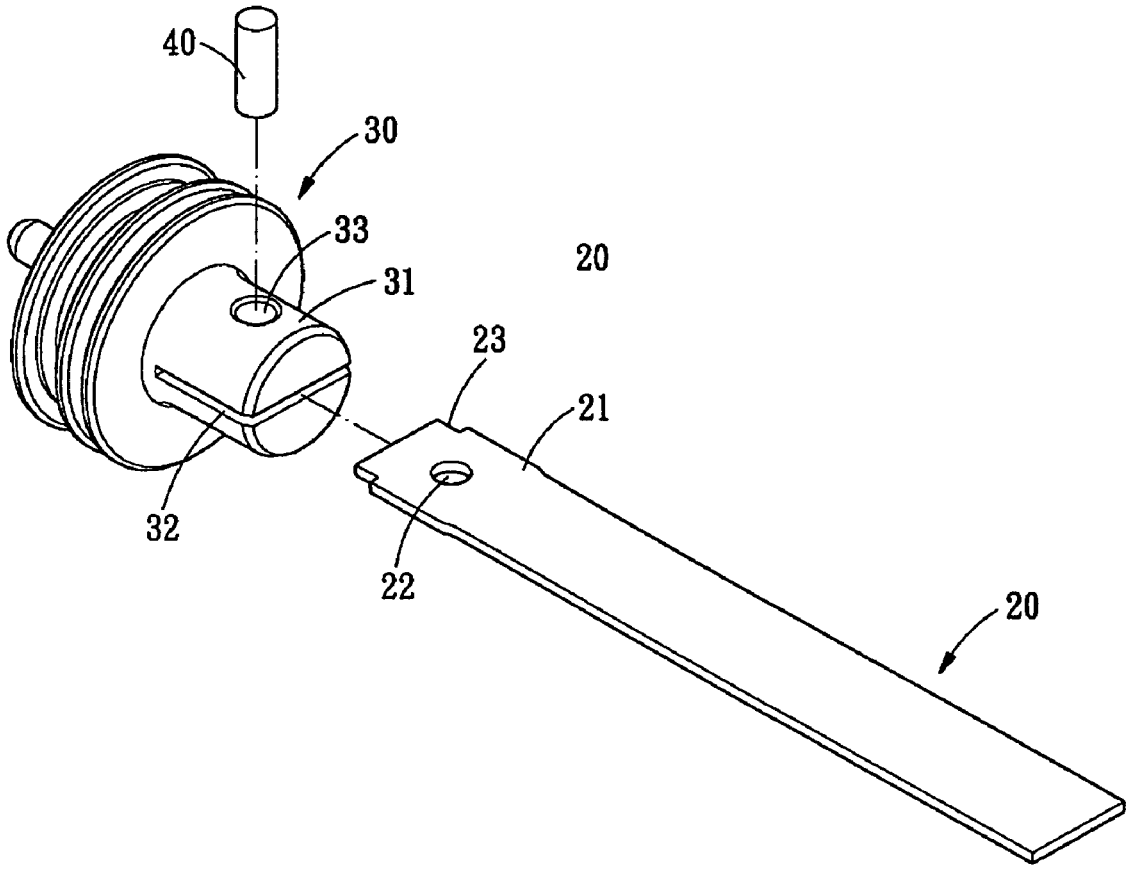
FIG. 4 is an exploded view of a striker assembly for a nailer in accordance with the present invention.
Figure 5:
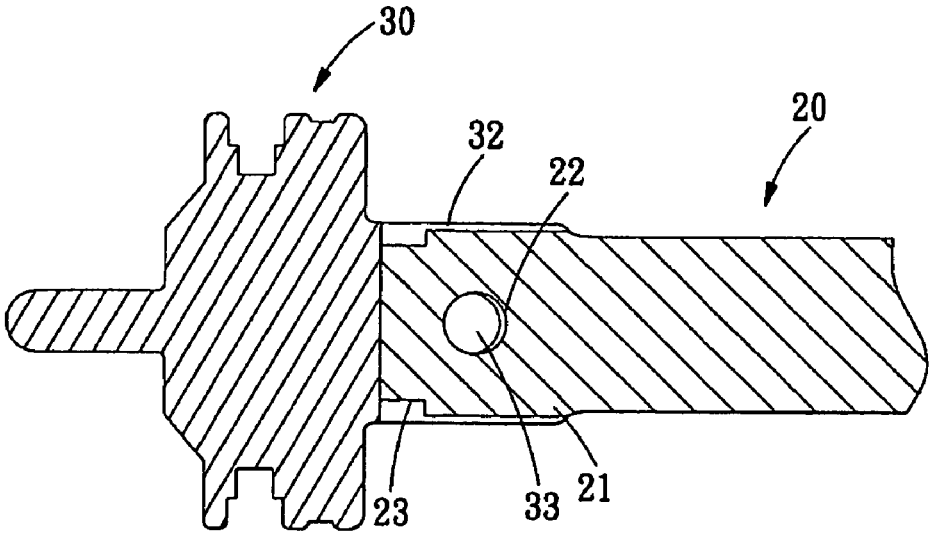
FIG. 5 is a cross sectional view for showing a part of the striker assembly of the present invention before the clamping portion is pressed.

Referring to FIGS. 4 and 5, a striker assembly for a nailer in accordance with the present invention is shown and comprises a striker 20 and a piston 30.

The striker 20 is provided with a connecting end 21 on which is formed a inserting hole 22, and at either side of the connecting end 21 is a gap 23.

The piston 30 is a step-like cylinder and is provided at an end thereof with a protrusive clamping portion 31. At a top end of the piston 30 is a receiving groove 32, and on the periphery of the piston 30 is an inserting hole 33. The connecting end 21 of the striker 20 is used to insert in the receiving groove 32 of the piston 30, making the inserting holes 22, 33 overlap each other, and then a pin 40 is inserted through the inserting holes 22, 33. Finally, two protruding portions 34 are made in the clamping portion 31 of the piston 30 by press machine according to the shape of the gaps 23 of the striker 20, as shown in FIG. 6, so that the protruding portions 34 are engaged with the gaps 23 of the striker 20.

Figure 6:
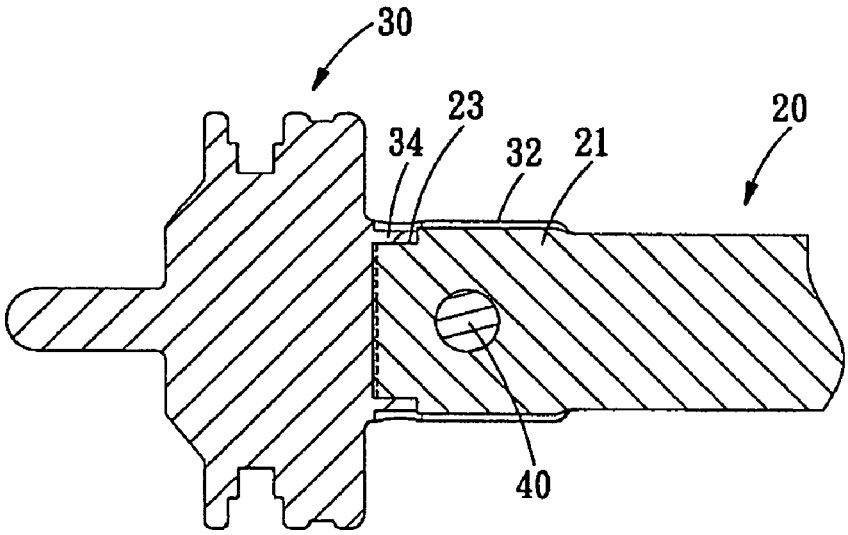
FIG. 6 is a cross sectional view for showing a part of the striker assembly of the present invention after the clamping portion is pressed.
Figure 7:
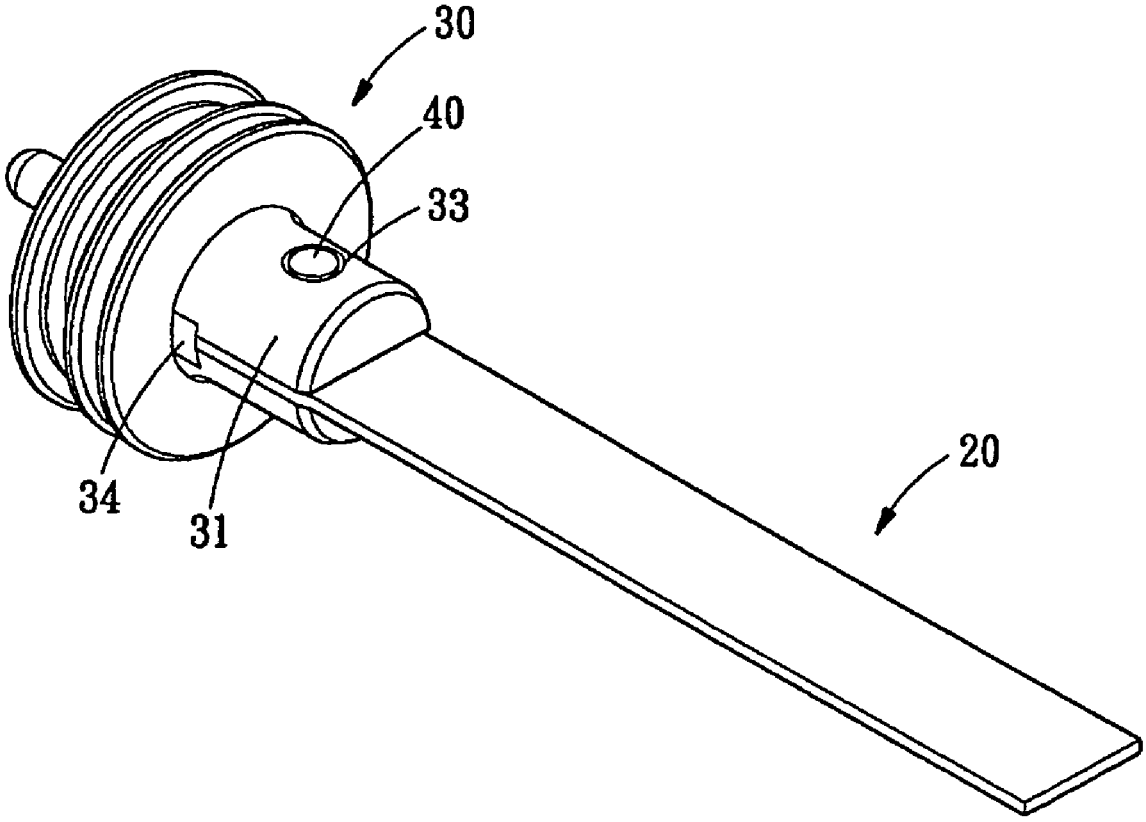
FIG. 7 is an assembly view of the striker assembly for a nailer in accordance with the present invention.
Figure 8:
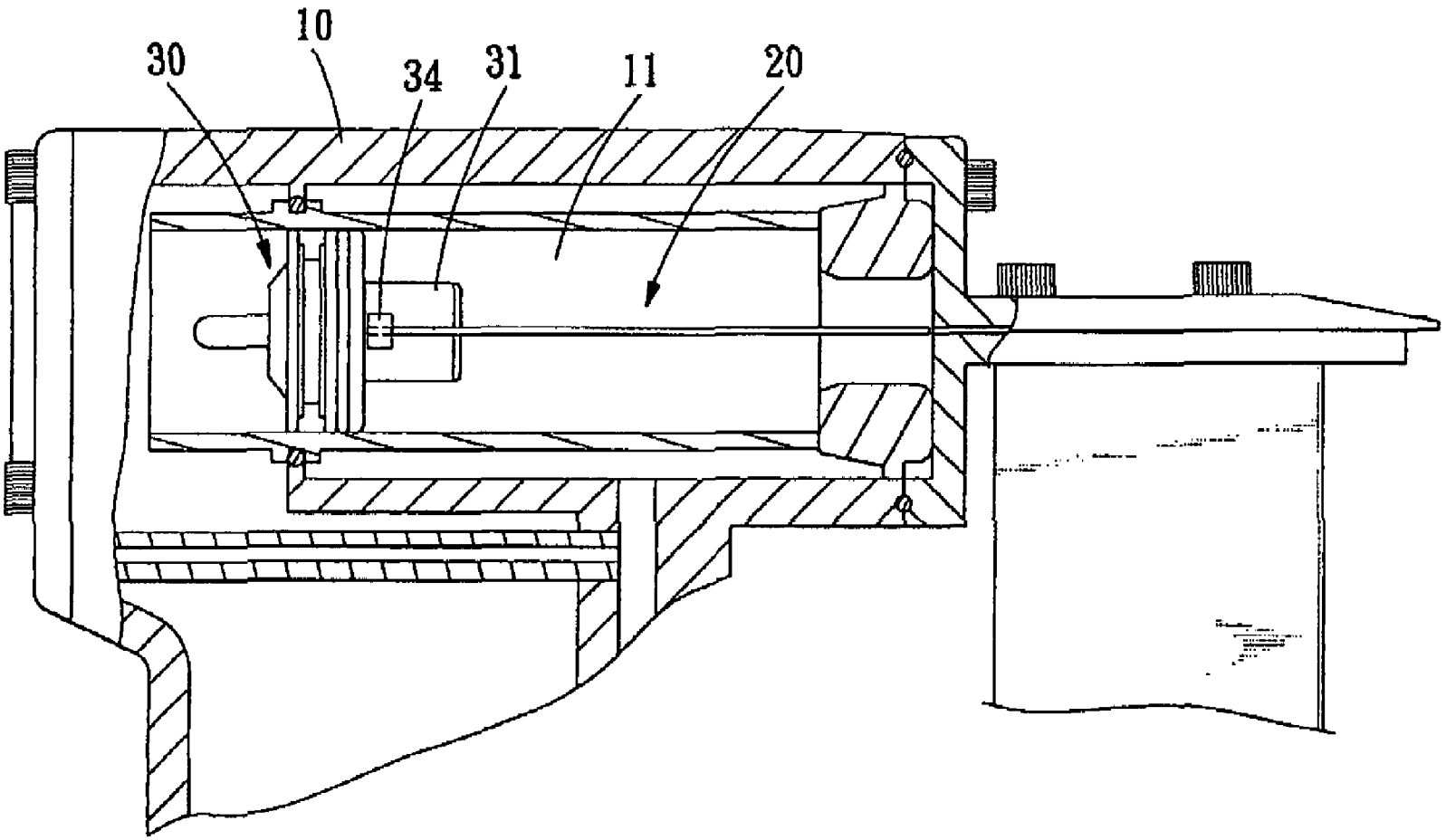
FIG. 8 shows the striker assembly of the present invention is being assembled in the air chamber of a nailer.

Referring further to FIGS. 5, 6 and 7, the inserting holes 22, 33 are formed on the striker 20 and the clamping portion 31 of the piston 30, respectively, and the inserting holes 22, 33 are aligned to each other for allowing insertion of the pin 40. After that, the protruding portions 34 are made in the clamping portion 31 of the piston 30 by press machine and conform to the shape of the gaps 23 of the striker 20, so that the protruding portions 34 are stably engaged with the gaps 23 of the striker 20 as a whole. By this method, the structure of the striker assembly is simplified and the production cost thereof is decreased. Besides, the connecting strength between the striker 20 and the piston 30 is improved, thus prolonging the service life of the striker assembly. FIG. 8 shows the striker assembly of the present invention assembled in the air chamber 11 of a nailer 10.

While we have shown and described various embodiments in accordance with the present invention, it should be clear to those skilled in the art that further embodiments may be made without departing from the scope of the present invention.

What is claimed is:

1. A striker assembly for a nailer comprising:

a striker having a connecting end, at the connecting end formed an inserting hole;

a piston having a protrusive clamping portion, at a top end of the clamping portion is formed a receiving groove for insertion of the connecting end of the striker, at a periphery of the clamping portion formed an inserting hole;

a pin inserted in the inserting holes of the striker and of the piston;

wherein a gap is formed at opposite side of the connecting end of the striker, and protruding portions are formed in the clamping portion of the piston by press machine and thus conform to the shape of the gaps of the striker, whereby the protruding portions are stably engaged with the gaps of the striker.

* * * * *